US011400721B2

(12) United States Patent
Seras Franzoso et al.

(10) Patent No.: US 11,400,721 B2
(45) Date of Patent: Aug. 2, 2022

(54) WIPING A PRINT HEAD

(71) Applicant: Hewlett-Packard Development Company, L.P., Spring, TX (US)

(72) Inventors: Mauricio Seras Franzoso, Sant Cugat del Valles (ES); Sheila Cabello Cabrera, Sant Cugat del Valles (ES); Aleix Fort Filgueira, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/977,771

(22) PCT Filed: Apr. 23, 2018

(86) PCT No.: PCT/US2018/028848

§ 371 (c)(1),
(2) Date: Sep. 2, 2020

(87) PCT Pub. No.: WO2019/209248

PCT Pub. Date: Oct. 31, 2019

(65) Prior Publication Data

US 2021/0031529 A1 Feb. 4, 2021

(51) Int. Cl.
*B41J 2/165* (2006.01)

(52) U.S. Cl.
CPC ..... *B41J 2/16535* (2013.01); *B41J 2/16552* (2013.01); *B41J 2002/16558* (2013.01); *B41J 2002/16573* (2013.01)

(58) Field of Classification Search
CPC ..... B41J 2/16535; B41J 2/16552; B41J 2002/16558; B41J 2002/16573; B41J 2002/1655
See application file for complete search history.

(56) References Cited

U.S. PATENT DOCUMENTS

| | | | |
|---|---|---|---|
| 7,025,432 | B2 | 4/2006 | Yamada |
| 2002/0171705 | A1 | 11/2002 | Rhoads et al. |
| 2005/0012777 | A1 | 1/2005 | Ishihara |
| 2009/0021553 | A1 | 1/2009 | Ishimatsu |
| 2009/0135219 | A1 | 5/2009 | Nathan |
| 2010/0128085 | A1 | 5/2010 | Silverbrook |

(Continued)

FOREIGN PATENT DOCUMENTS

| | | |
|---|---|---|
| CN | 1009721 | 9/1990 |
| CN | 101332713 A | 12/2008 |
| CN | 102649362 | 8/2012 |

(Continued)

OTHER PUBLICATIONS

International Search Report and Written Opinion dated Dec. 13, 2018, PCT Patent Application No. PCT/US2018/028848, filed Apr. 23, 2018, Federal Institute of Industrial Property, Moscow, Russia, 7 pages.

*Primary Examiner* — Sharon Polk
(74) *Attorney, Agent, or Firm* — HP Inc. Patent Department

(57) ABSTRACT

Methods to wipe a print head are described. In an example of a method, an amount of treatment fluid is determined based on a temperature of the print head and the print head is wiped with the determined amount of treatment fluid and a wiping medium.

13 Claims, 7 Drawing Sheets

(56) References Cited

U.S. PATENT DOCUMENTS

| | | | | |
|---|---|---|---|---|
| 2013/0100200 | A1* | 4/2013 | Hamasaki | B41J 2/16526 347/23 |
| 2014/0139587 | A1 | 5/2014 | Hildebrand et al. | |

FOREIGN PATENT DOCUMENTS

| | | | | |
|---|---|---|---|---|
| CN | 103818118 | | | 5/2014 |
| CN | 103860262 | A | | 6/2014 |
| CN | 205270212 | U | | 6/2016 |
| CN | 107323111 | | | 11/2017 |
| EP | 0870622 | | | 10/1998 |
| JP | H03258553 | | | 11/1991 |
| JP | H08276573 | | | 10/1996 |
| JP | 09075283 | A | * | 3/1997 |
| JP | 2008254295 | A | | 10/2008 |
| JP | 2012218399 | A | | 11/2012 |
| JP | 2013006306 | A | | 1/2013 |
| JP | 5401363 | B2 | | 1/2014 |
| JP | 2014240129 | A | | 12/2014 |

* cited by examiner

WIPING A PRINT HEAD

CLAIM FOR PRIORITY

The present application is a national stage filing under 35 U.S.C 371 of PCT application number PCT/US2018/028848, having an international filing date of Apr. 23, 2018, the disclosure of which is hereby incorporated by reference in its entirety.

BACKGROUND

In 2D and 3D printing a printing fluid, such as ink or agent, may be ejected by a fluid ejection device, such as via nozzles, onto a print medium or substrate. Fluid ejection devices may be piezo-electric or thermal-electric ink-jet print heads. In some examples, print heads are serviced in a service station. For example, an orifice plate of a print head may be wiped with a wiping medium to clean the print head.

DETAILED DESCRIPTION

Figure 1:
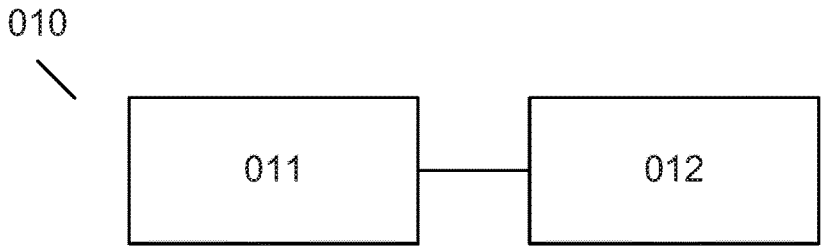
FIG. 1 schematically shows an example of a system to wipe a fluid ejection device.

In 2D and 3D printing, a fluid ejection device is to distribute printing fluid, agent or print material onto a print medium, such as on a substrate, a paper, a powder bed of 3D printing material or other suitable media. A fluid ejection device may comprise fluid delivery structure to provide printing fluid and may comprise at least one nozzle to eject printing fluid onto a media. In some examples, a fluid ejection device may be a print head. In some examples a print head comprises inner delivery structures, e.g. channels, to guide printing fluid to a series of print head dies. In an example, a print head die comprises fluid delivery structures, e.g. channels on a substrate or circuitry, and fluid ejection circuitry to eject the printing fluid from the nozzles mounted on the orifice plate of the print head die. The print head die may be a silicon die and the orifice plate may be a layer or substrate of the print head die, e.g. a top layer of the print head die.

In some examples the fluid ejection device is based on thermal inkjet or piezoelectric inkjet printing technology. In some examples different printing fluids are guided and ejected within a single print head die separately. In other examples, each print head die is configured to eject a single printing fluid whereby multiple print head dies are provided in a single print head to eject multiple different printing fluids. Printing fluids may comprise ink, agent, fusing agent, coalescing agent, binder, liquid compositions, pigments, dyes, glycol, water, latex or other materials.

A fluid ejection device may be, e.g., a print head, may be installed in a printer, e.g. in an ink-jet printer, and printing fluid may be distributed by the fluid ejection device onto a print medium provided to the printer.

In some examples, printing fluid may cure or gather on an orifice plate of a print head or may be spilled on nozzles of the fluid ejection device. For example, inks containing latex may cure on an orifice plate of a print head due to high temperatures of the print head die. Therefore a fluid ejection device may be serviced. In some examples, a fluid ejection device may be cleaned in a service station to remove cured or spilled printing fluid.

A service station may provide a wiping medium, such as a cloth or a web, to wipe the fluid ejection device, e.g. to wipe an orifice plate of a print head. In some examples, treatment fluid is used for wiping a fluid ejection device. Treatment fluid, such as water or water with additives, may be deposited onto a wiping medium and the fluid ejection device may be wiped with the treated wiping medium. In some examples, treatment fluid is applied onto the fluid ejection device, e.g. onto the orifice plate of a print head, and then a wiping medium is used to clean the treated fluid ejection device. In some examples, applying treatment fluid for wiping a fluid ejection device may improve the wiping process. For example, more spilled, crusted or cured printing fluid may be removed or dissolved thereby improving the cleaning operation of the fluid ejection device.

In some examples, after wiping or servicing a fluid ejection device with treatment fluid, used treatment fluid may be collected in a container. In an example, treatment fluid may drop from the wiping medium or the fluid ejection device into a container. In a further example, treatment fluid may be squeezed from a wiping medium into a container, or may be otherwise collected in a service station. In some examples, a container to collect used treatment fluid may overflow and it may be desired to reduce or prevent an overflow of treatment fluid.

Examples described herein, describe a method to wipe a fluid ejection device. In some examples, application of treatment fluid for wiping is controlled based on a temperature, e.g., of the fluid ejection device. In some examples described herein, treatment fluid consumption may be reduced. For example, fluid ejection devices with a temperature below a temperature threshold, less treatment fluid is ejected for cleaning or the fluid ejection device may be wiped without treatment fluid application.

In an example, fluid ejection devices having a temperature higher than a temperature threshold may be determined to be wiped with a higher amount of treatment fluid, and thus crusted printing fluid may be removed more efficiently from the fluid ejection device. In some examples described herein, modifying a temperature of the fluid ejection device may be performed when applying treatment fluid, e.g., if printing fluid is applied based on the temperature of the fluid ejection device. For example, a fluid ejection device may be cooled by applying treatment fluid, e.g. when a temperature associated to the fluid ejection device is above a threshold value.

FIG. 1 schematically shows an example of a system (010) to wipe a fluid ejection device. The system comprises a fluid applicator (011) to apply a treatment fluid for wiping a fluid ejection device and a controller (012) to receive a temperature signal and to control the fluid applicator (011) to apply the treatment fluid based on the temperature signal. A fluid applicator (011) may comprise a delivery structure to deliver treatment fluid. For example, treatment fluid may be provided from a supply container and, in a further example, may be pumped through a delivery structure. Treatment fluid may be a liquid composition, water or another suitable fluid to clean a nozzle and may comprise additives. A fluid applicator (011) may comprise sprayers, injectors, nozzles, needles, treatment fluid ejection mechanics, valves, pumps or further components to eject or deposit treatment fluid.

The controller (012) may comprise circuitry to control the fluid applicator (011) to apply treatment fluid. For example, valves of the fluid applicator (011) may be controlled to open, close or to open an intermediate position between fully open and fully closed so that an amount of treatment fluid may be ejected. In some examples, pumps or other fluid delivery structure may be controlled so that treatment fluid application is controlled by the controller (012). For example, a power supply of a pump to supply treatment fluid via a delivery structure of the fluid applicator (011) may be controlled. For example, a pump of the fluid applicator (011) may be controlled so that an amount of treatment fluid can be ejected or applied by the fluid applicator (011).

The controller (012) may be a microcontroller, an integrated circuit, an embedded system or any combination of circuitry and executable instructions representing a control program to perform a controlling operation as will be described in more detail with reference to FIG. 6.

The controller (012) may be to receive a temperature signal. In some examples, the controller (012) receives a temperature associated to a fluid ejection device, such as a temperature of a nozzle of a print head. The controller may receive a temperature signal related to a set of nozzles, to a print head array, to a print head die, to a sub-set of nozzles in a print head or to a fluid ejection device, e.g. installed in a printer. In some examples, the controller (012) may be further to receive a temperature signal of the ambient environment or of further components of a printer.

Figure 2:
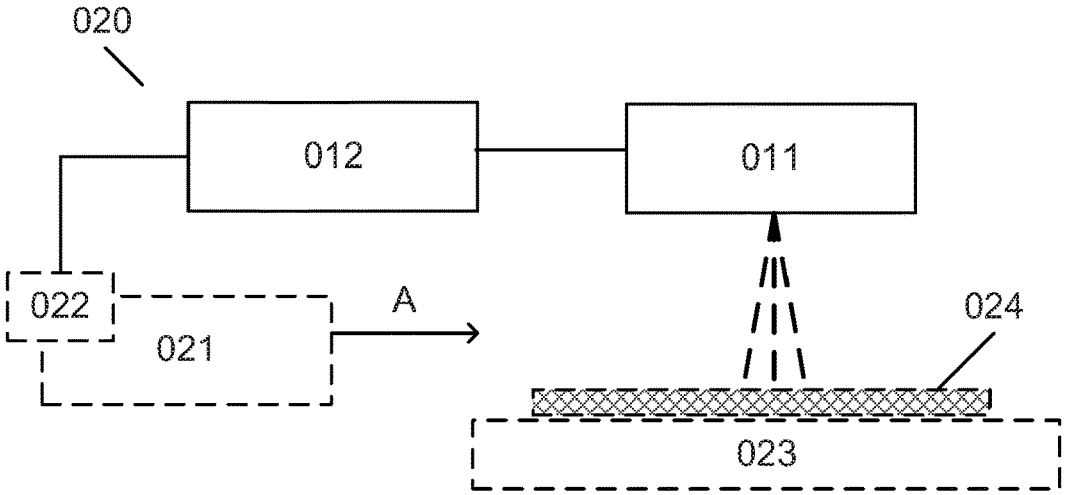
FIG. 2 schematically shows an example of a system to wipe a fluid ejection device.

In some examples, the controller (012) comprises circuitry to receive a temperature signal from a temperature sensor. For example, FIG. 2 schematically depicts a temperature sensor (022) to measure the temperature of the fluid ejection device (021) to be cleaned or wiped. The temperature sensor (022) may be attached to the fluid ejection device (021), e.g. may be part of a print head. The temperature sensor (022) may be to measure a temperature of a single nozzle or of a set of nozzles, such as of a print head, of a print head array, of a print head die, or of an orifice plate of a print head. The temperature sensor (022) may be a thermistor. The controller (012) is to control the fluid applicator (011) to apply the treatment fluid based on the temperature signal, e.g. based on the measured temperature by the temperature sensor (022).

In some examples, the controller (012) controls the fluid applicator (011) to apply treatment fluid when the received temperature signal exceeds a predetermined temperature or when the received temperature signal is within a range of temperatures. In some examples, the controller (012) controls the fluid applicator (011) to apply no treatment fluid when the received temperature signal is below a predetermined temperature or when the received temperature signal is not within a range of temperatures. In some examples, the controller (012) controls the fluid applicator (011) to apply an amount of treatment fluid based on a mathematical formula having the received temperature signal as a variable, e.g. an amount directly proportional, linearly related or step-wise related to the received temperature signal.

Figure 3:
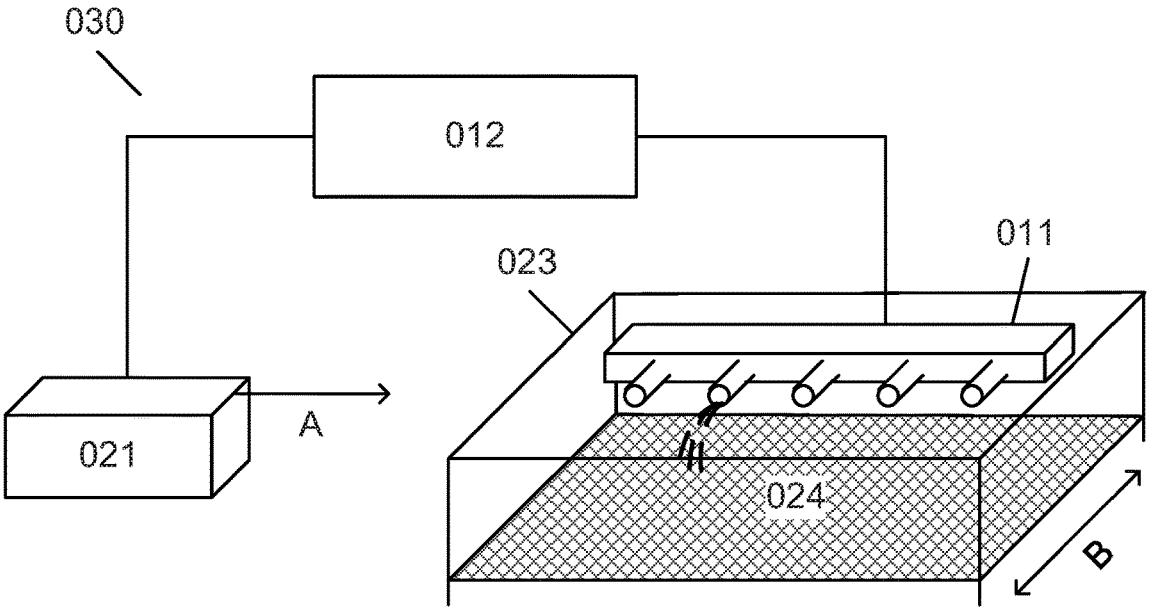
FIG. 3 schematically shows an example of a system to wipe a fluid ejection device.

FIG. 2 and FIG. 3 schematically show examples of treatment fluid application onto a wiping medium (024). For example, a service station (023) may provide a wiping medium (024), such as a web, a cloth, a textile, a fabric or a synthetic material and the service station (023) may comprise motors or actuators to provide fresh, untreated wiping medium (024) from for example a roll and to move the wiping medium (024). A service station (023) may be a part of a printer and may be replaceable. The service station (023) may comprise the fluid applicator (011). The fluid applicator (011) may be controlled to apply an amount of treatment fluid onto the provided wiping medium (024) based on a temperature signal received by the controller (012), e.g. based on a temperature of the fluid ejection device (021), which may be measured by a sensor (022). In some examples, the fluid applicator (011) may apply treatment fluid onto the fluid ejection device (021), e.g. onto nozzles or an orifice plate of a print head. In some examples, the fluid ejection device (021) may move, e.g. longitudinally, from a printing position to a servicing or wiping position, as for example depicted by arrow (A) in FIGS. 2 and 3. The fluid ejection device (021) may be attached at a carriage of a printer, e.g. a carriage carrying a print head, and may be guided to a service station (023).

In a service station (023) the wiping medium (024) may contact the fluid ejection device (021), e.g. an orifice plate of a print head, to wipe and clean the fluid ejection device (021). To wipe the fluid ejection device (021), the wiping medium (024) may be moved relatively to the fluid ejection device (021), e.g. so that an orifice plate or a plurality of nozzles of a print head is wiped and cleaned. The service station (023) may move the wiping medium (024) relative to the fluid ejection device (021) for wiping or servicing, for example a wiping medium may be moved traversal along a second direction (B), such as perpendicular to a first direction (A). The service station (023) may comprise a container, e.g. a replaceable maintenance cartridge (not shown), to collected excess treatment fluid when treatment fluid is dropping or is squeezed from the wiping medium (024). A fluid ejection device (021), a temperature sensor (022), a wiping medium (024), treatment fluid and a service station (023) may be replaceable components or supplies and may be provided to a system for wiping a fluid ejection device as described herein.

In some examples, the fluid applicator (011) may be to apply treatment fluid for wiping a fluid ejection device (021), wherein the fluid ejection device may be a nozzle array. A nozzle array (021) may be an array of nozzles, an array of sub-sets of nozzles, an array of fluid ejection devices, an array of print heads, an array of print head dies, or an array of sub-sets of nozzles, each sub-set related to a color or a characteristic of printing fluid to be printed or deposited with that sub-set of nozzles. The controller (012) may be to receive a temperature signal of the nozzle array (021) and may be to control the fluid applicator (011) to apply treatment fluid for wiping a set of nozzles from the nozzle array based on the temperature signal. The controller (012) may be to control the fluid applicator (011) to apply treatment fluid for wiping a sub-set of nozzles, a nozzle, a fluid ejection device, a print head, or a print head die from the nozzle array (021).

Figure 4:
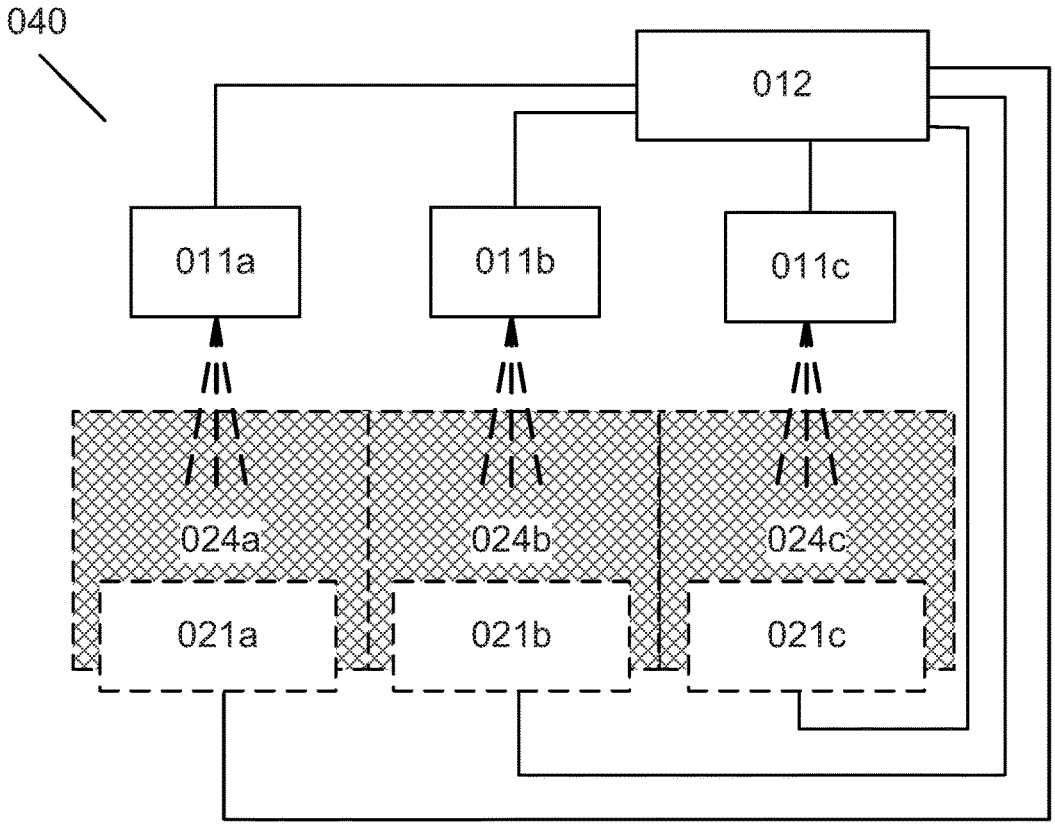
FIG. 4 schematically shows an example of a system to wipe a fluid ejection device.
Figure 5:
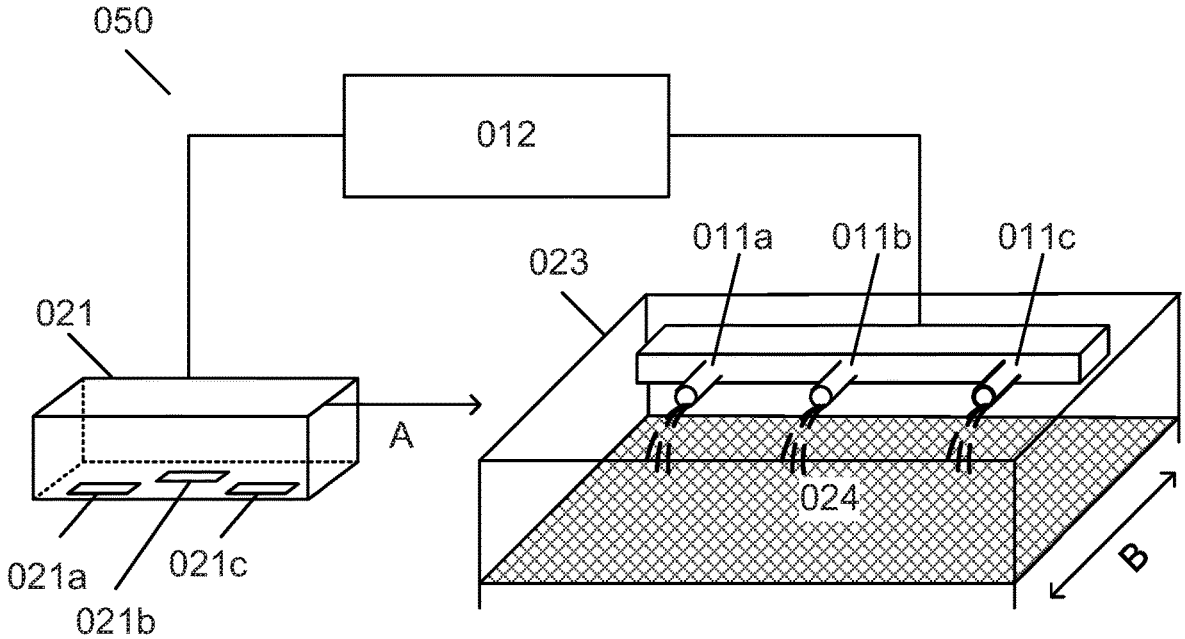
FIG. 5 schematically shows an example of a system to wipe a fluid ejection device.

For example, FIGS. 4 and 5 schematically show a nozzle array (021*a*, 021*b*, 021*c*) comprising a set of nozzles. In some examples, the nozzle array (021*a*, 021*b*, 021*c*) may be a series of sub-sets of nozzles, each sub-set of nozzles (021*a* or 021*b* or 021*c*) related to a different color of printing fluid, e.g. such as different print head dies, different trenches of a print head die or different parts of an orifice plate of a print head, as schematically illustrated in FIG. 5. A nozzle array (021*a*, 021*b*, 021*c*) may comprise one or more set of nozzles or one or more sub-sets of nozzles.

In some examples, the controller (012) may be to receive a temperature signal related to the whole nozzle array (021*a*, 021*b*, 021*c*) and in some examples, the controller (012) may be to receive a temperature signal for each nozzle or for each sub-set of nozzles from the array (021*a*, 021*b*, 021*c*), such as a temperature signal per print head die, per trench of a print head die, per fluid ejection device, per print head or per sub-set of nozzles related to a color of printing fluid. Based on the received temperature signal of the nozzle array (021*a*, 021*b*, 021*c*), the controller (012) is to control the fluid applicator (011) to apply treatment fluid for wiping the nozzle array (021*a*, 021*b*, 021*c*). In some examples, as illustrated in FIGS. 4 and 5, a fluid applicator may comprise a series of fluid applicators (011*a*, 011*b*, 011*c*) and the controller (012) may be to control each fluid applicator of the series of fluid applicators (011*a*, 011*b*, 011*c*) to apply treatment fluid for wiping the nozzle array (021*a*, 021*b*, 021*c*).

For example, the controller (012) may be to receive a temperature of each nozzle or of each sub-set of nozzles of an array (021*a*, 021*b*, 021*c*) and may be to determine for each nozzle or for each sub-set of the array (021*a*, 021*b*, 021*c*) an amount of treatment fluid based on the temperature per nozzle or per sub-set. In some examples, the controller (012) may relate each nozzle or each sub-set of the nozzle array (021*a*, 021*b*, 021*c*) with a section of the wiping medium (024*a*, 024*b*, 024*c*) as illustrated in FIG. 4, so that each nozzle or each sub-set of the array (021*a*, 021*b*, 021*c*) may be to be wiped with the related section of the wiping medium (024). The controller (012) may be to control the fluid applicators (011*a*, 011*b*, 011*c*) to apply on each section of the wiping medium (024*a*, 024*b*, 024*c*) the determined amount of treatment fluid for the nozzle or for the sub-set of nozzles related to that section (024*a* or 024*b* or 024*c*). For example, for each nozzle or for each sub-set of nozzles of the array (021*a*, 021*b*, 021*c*) treatment fluid application may be controlled independently based on the temperature per nozzle or per sub-set of nozzles and the nozzle array (021*a*, 021*b*, 021*c*) may then be wiped simultaneously with the provided wiping medium (024).

In some examples, some colors of printing fluid may be consumed more than others when printing a print job or may have some characteristics so that the temperature of a sub-set of nozzles related to or ejecting those colors of printing fluid may be higher than the temperature of other sub-sets of nozzles, e.g. when using thermal ink-jet print heads. In some examples, more printing fluid may be cured or crusted on those sub-sets of nozzles which have a higher temperature. The controller (012) may be to receive a temperature signal per sub-set of nozzles and may be to determine a higher amount of treatment fluid to be applied for cleaning those sub-sets of nozzles having a higher temperature.

Figure 6:
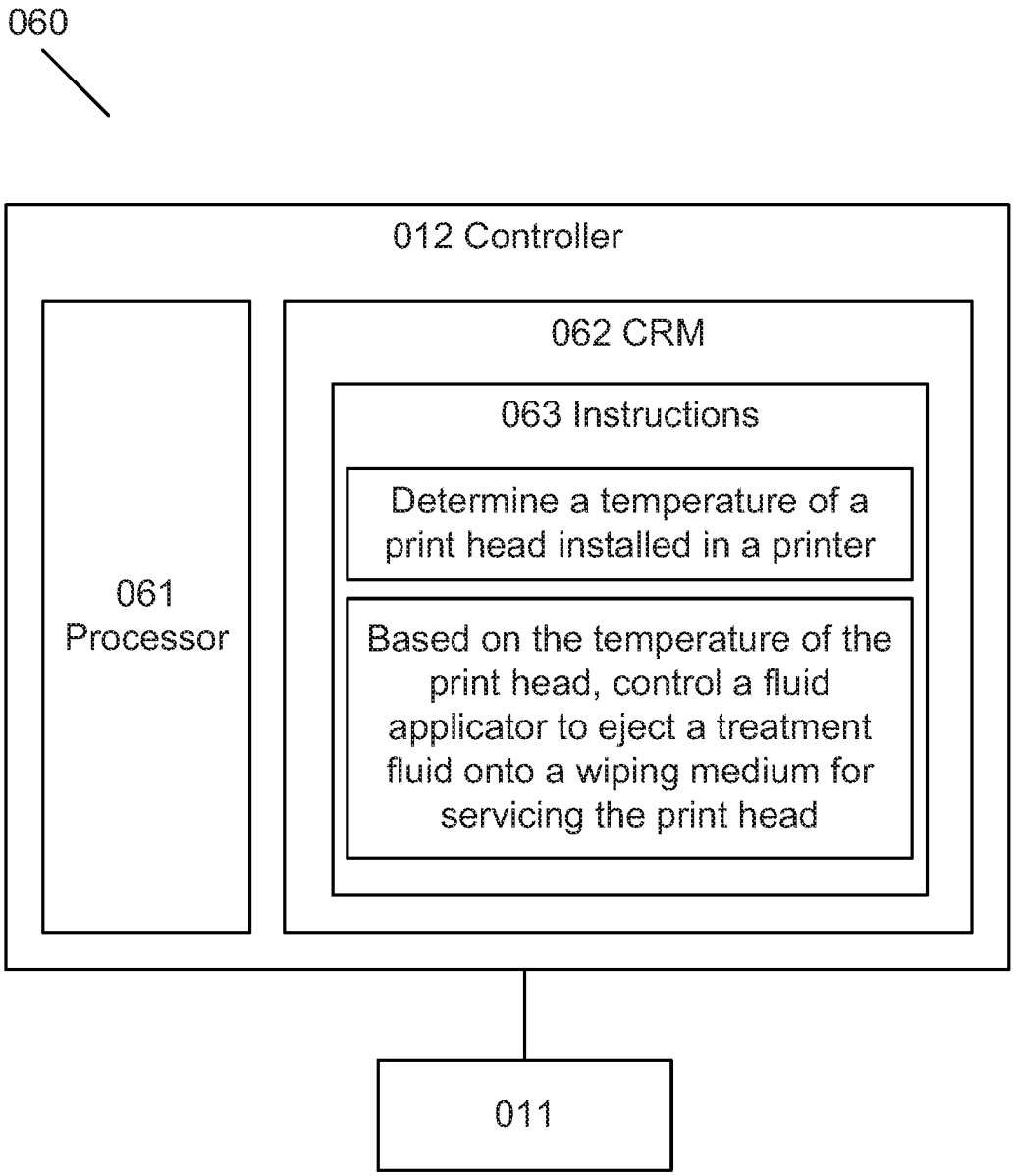
FIG. 6 schematically shows an example of a computer readable storage medium comprising instructions for servicing a print head, the instructions executable by a processor.

FIG. 6 schematically shows a controller, e.g. controller (012) of system (010), comprising instructions for servicing a fluid ejection device (021), such as a nozzle array or a print head. A controller (012) may comprise circuitry to control a fluid applicator (011). In some examples, the controller (012) may comprise circuitry to control or to receive a signal from a temperature sensor, a print head, a nozzle, a fluid ejection device or further components of a printer or of a system (010) to wipe a fluid ejection device. A controller (012) comprises a processor (061) having any appropriate circuitry capable of processing (e.g. computing) instructions, such as one or multiple processing elements, e.g. a central processing unit (CPU), a graphical processing unit (GPU), a semiconductor-based microprocessor, a programmable logic device (PLD), or the like. Processing elements may be integrated in single device or distributed across devices.

A controller (012) comprises a computer-readable storage medium (062) comprising instructions (063) to determine a temperature of a print head and based on the temperature associated to the print head, to control a fluid applicator (011) to eject a treatment fluid onto a wiping medium for servicing the print head. The computer readable storage medium (062) may comprise volatile, e.g. RAM, and non-volatile components, e.g. ROM, hard disk, CD-ROM, flash memory, etc. and may be an electronic, magnetic, optical, or other physical storage device that is capable of containing (i.e. storing) executable instructions (063). A storage medium (062) may be integrated in the same device as the processor (061) or it may be separate but accessible to the processor (061). The instructions (063) comprise instructions executable by the processor (061) and the instructions (063) may implement a method to wipe a fluid ejection device.

In some examples, the instructions (063) comprise instructions that, when executed by a processor (061), cause the processor (061) to control the fluid applicator (011) to eject the treatment fluid onto the wiping medium if the temperature of the print head is within a range of temperatures and to control the fluid applicator (011) to eject less or no treatment fluid onto a wiping medium, if the temperature of the print head is not within the range of temperatures. In an example, the controller (012) is to receive a temperature signal associated to the printhead and to determine, in view of such temperature signal the amount of printing fluid to be used in a wiping operation.

In some examples, the instructions (063) comprise instructions that, when executed by a processor (061), cause the processor (061) to determine a temperature per set of nozzles of a print head array and based on the temperature per set of nozzles, to determine for each set of nozzles an amount of treatment fluid to eject with a fluid applicator (011) onto a wiping medium for servicing each set of nozzles. For example, each set of nozzles may relate to a color or a characteristic of printing fluid, or may be a print head die or may be a print head. A print head array may comprise one or more print heads. The instructions (063) may comprise instructions that, when executed by a processor (061), cause the processor (061) to control the system (060) to wipe the print head array with the determined amounts of treatment fluid and a wiping medium.

Figure 7:
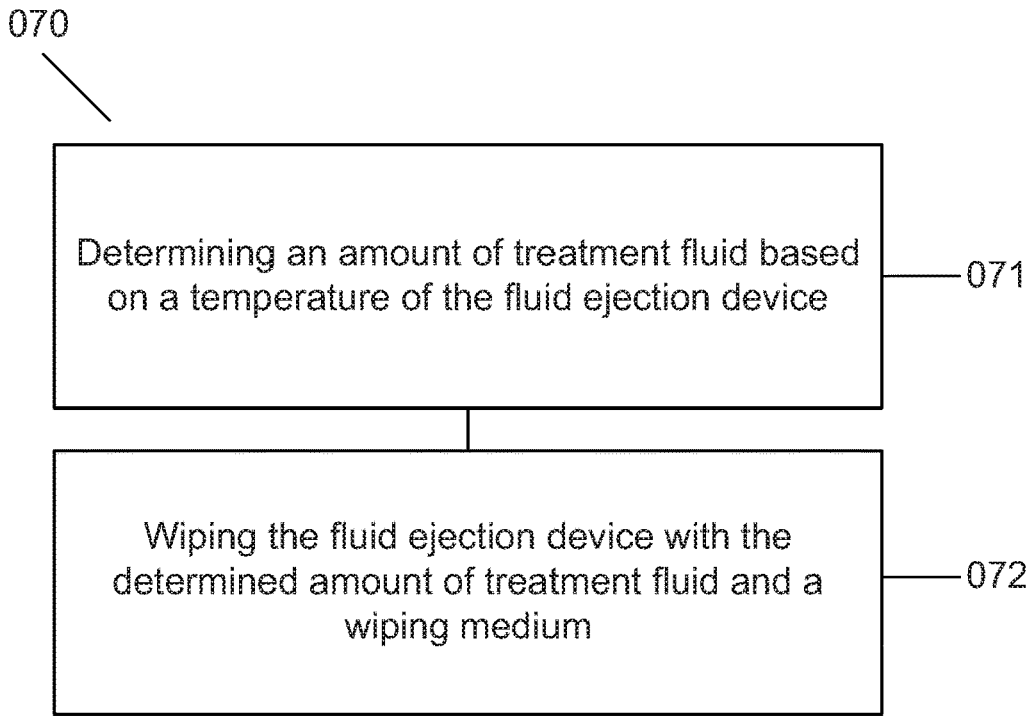
FIG. 7 shows a flow diagram of an example of a method to wipe a fluid ejection device.
Figure 8:
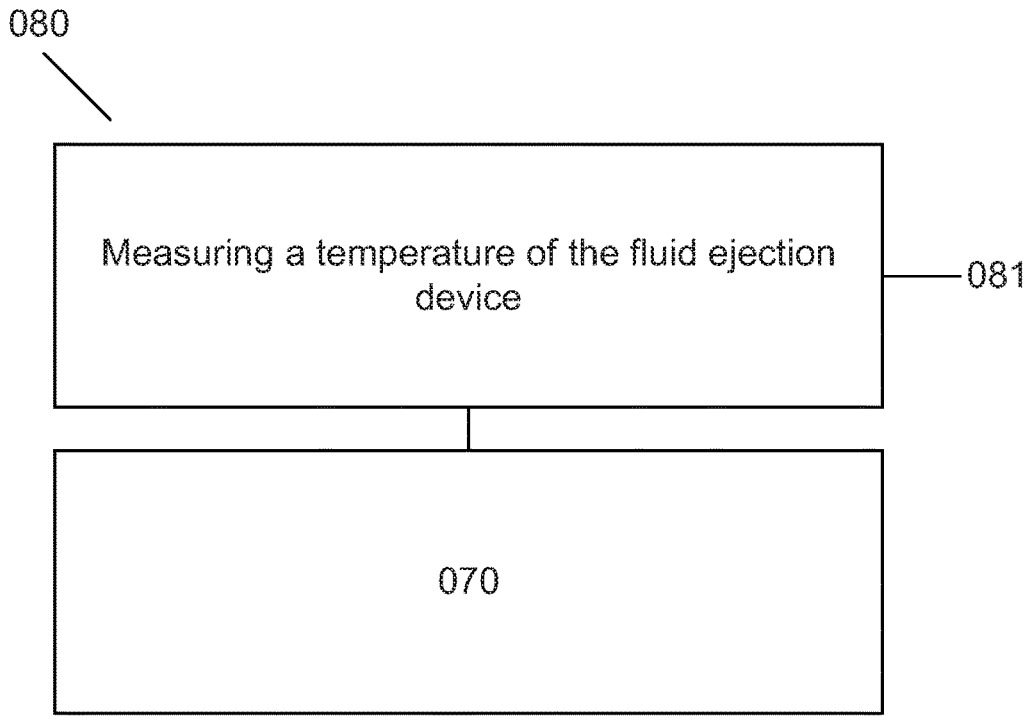
FIG. 8 shows a flow diagram of an example of a method to wipe a fluid ejection device.

FIG. 7 schematically shows a flow diagram of an example of a method (070) to wipe a fluid ejection device. The method (070) may be implemented as instructions (063) of controller (012) to control a system (060), as illustrated in FIG. 6. The method (070) includes, at block 071, determining an amount of treatment fluid based on a temperature of a fluid ejection device, based on a temperature of a nozzle, a nozzle array, a sub-set of nozzles, a print head, etc. The method (070) includes, at block 072, wiping the fluid ejection device with the determined amount of treatment fluid and a wiping medium, e.g. wiping the fluid ejection device in a service station (with a provided wiping medium, as depicted in FIGS. 2 and 3. In some examples, the method further includes, at block 081, measuring a temperature of a fluid ejection device, as schematically shown in flow diagram of FIG. 8. For example, a temperature may be measured with a temperature sensor.

Figure 9:
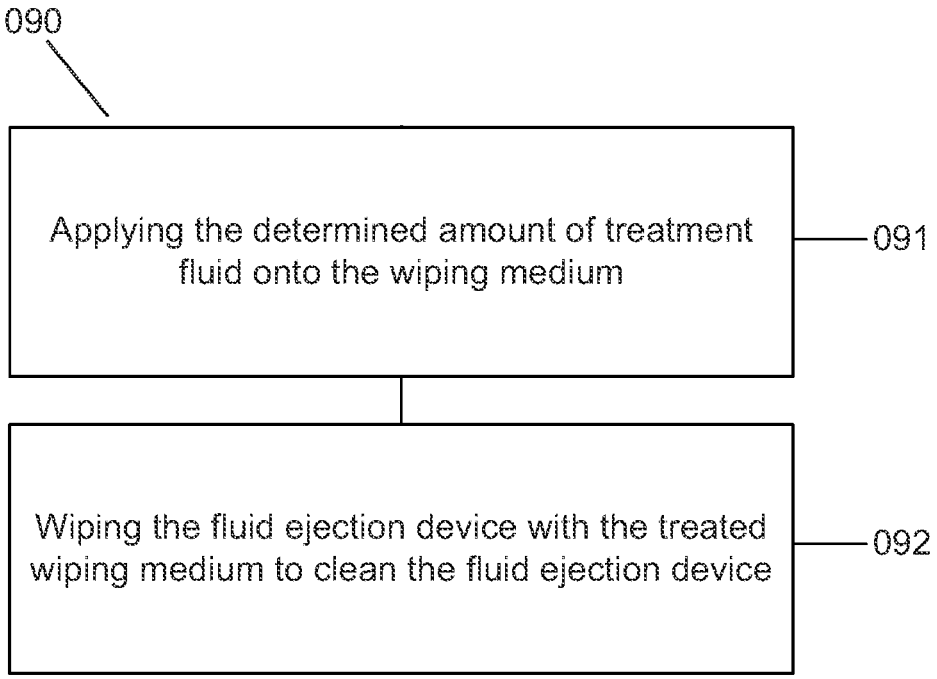
FIG. 9 shows a flow diagram of an example of a method to wipe a fluid ejection device.

In some examples as shown in flow diagram of FIG. 9, a method to wipe a fluid ejection device further comprises, at block 091, applying a determined amount of treatment fluid onto a wiping medium and, at block 092, wiping a fluid ejection device with the treated wiping medium to clean the fluid ejection device. For example, a determined amount of treatment fluid may be deposited with a fluid applicator onto a wiping medium provided by a service station to clean a fluid ejection device. In some examples, a method to wipe a fluid ejection device comprises applying a determined amount of treatment fluid onto an orifice plate of a fluid ejection device, e.g. onto an orifice plate of a print head, and wiping the treated fluid ejection device with a wiping medium to clean the fluid ejection device.

In some examples, a method to wipe a fluid ejection device further includes applying an amount of treatment fluid onto a wiping medium if a temperature of the fluid ejection device exceeds a first predetermined temperature, and wiping the fluid ejection device with the treated wiping medium at a first wiping frequency. For example, a determined amount of treatment fluid may be applied with a fluid applicator onto a wiping medium and the fluid ejection device may be wiped with the treated wiping medium provided by a service station. A fluid ejection device may be wiped at a first frequency, e.g. after each number of passes of the fluid ejection device over a print medium in a print job. For example, a fluid ejection device may be attached at a carriage scanning along an axis over a print medium and each first number of passes the fluid ejection device may be guided by the carriage to a service station for wiping. The fluid applicator may apply a determined amount of treatment fluid before each wiping cycle, e.g. when a fluid ejection device moves to a service station for wiping.

In some examples, a method to wipe a fluid ejection device further includes determining if a temperature of the fluid ejection device exceeds a second temperature, the second temperature higher than the first temperature, and wiping the fluid ejection device with a treated wiping medium at a second wiping frequency, the second wiping frequency higher than the first wiping frequency. For example, each second number of passes over a print medium a fluid ejection device may be guided to a service station for wiping with a determined amount of treatment fluid.

Figure 10:
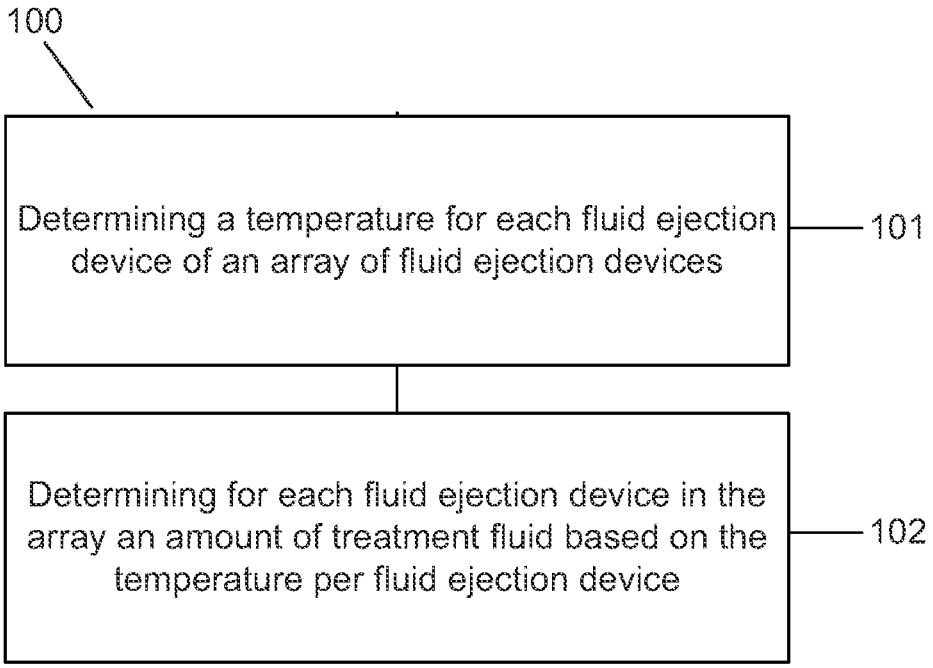
FIG. 10 shows a flow diagram of an example of a method to wipe a fluid ejection device.

FIG. 10 shows a flow diagram of an example of a method (100) including the method (070) to wipe a fluid ejection device. The method (100) further comprises, at block 101, determining a temperature for each fluid ejection device of an array of fluid ejection devices, and, at block 102, determining for each fluid ejection device in the array an amount of treatment fluid based on the temperature per fluid ejection device. For example, a fluid ejection device in an array may be a set of nozzles of a print head, e.g. a sub-set of nozzles related to a color or another characteristic of a printing fluid deposited with that sub-set. For example, each fluid ejection device of the array may comprise a temperature sensor to measure a temperature per fluid ejection device.

Figure 11:
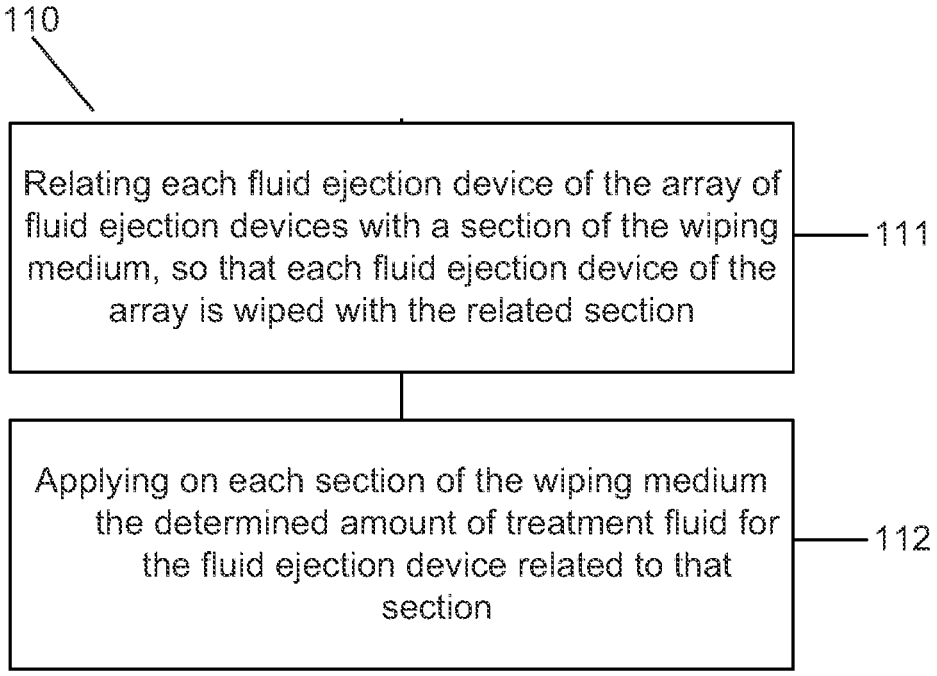
FIG. 11 shows a flow diagram of an example of a method to wipe a fluid ejection device.

FIG. 11 shows a flow diagram of an example of a method (110) including the method (100) to wipe an array of fluid ejection devices. The method (110) further comprises, at block 111, relating each fluid ejection device of the array of fluid ejection devices with a section of a wiping medium, so that each fluid ejection device of the array is wiped with the related section, and, at block 112, applying on each section of the wiping medium a determined amount of treatment fluid for the fluid ejection device related to that section, as for example sections of a wiping medium illustrated in FIG. 4. In some examples, treatment fluid may be applied by a series of fluid applicators, as illustrated in FIG. 5, and each fluid ejection device may be wiped with the relating section of a wiping medium.

The following terminology is understood to mean the following when recited by the description or the claims. The word "comprising" does not exclude the presence of elements other than those listed, the word "including" or "having" does not exclude the presence of elements other than those listed, "a", "an" or "the" does not exclude a plurality and a "series" or "plurality" does not exclude a singularity. The words "or" and "and" have the combined meaning "and/or" except combinations of listed features where at least some of such features and/or elements are mutually exclusive within the context.

All of the features disclosed in the claims and description (including drawings), and/or all of the elements of any method or process so disclosed, may be combined in any combination and order, except combinations where at least some of such features and/or elements are mutually exclusive.

The invention claimed is:

1. A method to wipe a fluid ejection device comprising:

determining, by a processor, an amount of treatment fluid based on a temperature of the fluid ejection device;

causing, by the processor, the determined amount of treatment fluid to be ejected onto a wiping medium to wipe the fluid ejection device when the temperature of the fluid ejection device is within a predetermined range of temperatures; and causing, by the processor, no treatment fluid to be elected when the temperature of the fluid ejection device is not within the predetermined range of temperatures.

2. The method of claim 1, further comprising:

measuring the temperature of the fluid ejection device by a temperature sensor.

3. The method of claim 1, further comprising:

applying the determined amount of treatment fluid onto the wiping medium; and wiping the fluid ejection device with the wiping medium to clean the fluid ejection device.

4. The method of claim 1, further comprising:

applying the determined amount of treatment fluid onto an orifice plate of the fluid ejection device; and wiping the orifice plate of the fluid ejection device with the wiping medium to clean the fluid ejection device.

5. The method of claim 1, further comprising:

wiping the fluid ejection device with the wiping medium at a first wiping frequency.

6. The method of claim 1, further comprising:

determining a temperature for each fluid ejection device of an array of fluid ejection devices; and determining for each fluid ejection device in the array of fluid ejection devices the determined amount of treatment fluid based on the temperature of the respective fluid ejection device in the array of fluid ejection devices.

7. The method of claim 6, further comprising:

relating each fluid ejection device of the array of fluid ejection devices with a section of the wiping medium, so that each fluid ejection device of the array of fluid ejection devices is to be wiped with the related section; and applying on each section of the wiping medium the determined amount of treatment fluid for the respective fluid ejection device in the array of fluid ejection devices related to that section.

8. A system comprising:

a fluid applicator to apply a treatment fluid for wiping a fluid ejection device; and a controller to receive a measurement of a temperature of the fluid ejection device, control the fluid applicator to apply the treatment fluid when the temperature of the fluid ejection device is within a predetermined range of temperatures, and control the fluid applicator to eject no treatment fluid when the temperature of the fluid ejection device is not within the predetermined range of temperatures.

9. The system of claim 8, further comprising:

a temperature sensor to measure the temperature of the fluid ejection device, wherein the controller is to receive the measured temperature of the fluid ejection device from the temperature sensor.

10. The system of claim 8, further comprising:

a service station to provide a wiping medium for wiping the fluid ejection device, wherein the fluid applicator is to apply the treatment fluid onto the wiping medium.

11. The system of claim 8, wherein the fluid applicator is to apply the treatment fluid for wiping a nozzle array, and wherein the controller is to receive a measurement of a temperature of the nozzle array and is to control the fluid applicator to apply the treatment fluid for wiping a set of nozzles in the nozzle array based on the temperature of the nozzle array.

12. A non-transitory computer readable storage medium storing instructions that, when executed by a processor, cause the processor to:

determine a temperature of a print head installed in a printer;

based on the temperature of the print head, control a fluid applicator to eject a treatment fluid onto a wiping medium for servicing the print head when the temperature of the print head is within a predetermined range of temperatures; and control the fluid applicator to eject no treatment fluid onto the wiping medium when the temperature of the print head is not within the predetermined range of temperatures.

13. The non-transitory computer readable storage medium of claim 12, further comprising instructions that, when executed by the processor, cause the processor to:

determine a temperature of each set of nozzles of a print head array; and based on the temperature of each set of nozzles, determine for each set of nozzles an amount of treatment fluid to eject from the fluid applicator onto the wiping medium for servicing the respective set of nozzles.

* * * * *